United States Patent [19]

Poa et al.

[11] Patent Number: 4,995,948

[45] Date of Patent: Feb. 26, 1991

[54] APPARATUS AND PROCESS FOR THE ELECTROLYTIC REDUCTION OF URANIUM AND PLUTONIUM OXIDES

[75] Inventors: David S. Poa; Leslie Burris; Robert K. Steunenberg, all of Naperville; Zygmunt Tomczuk, Orland Park, all of Ill.

[73] Assignee: The United States of America as represented by the United States Department of Energy, Washington, D.C.

[21] Appl. No.: 384,195

[22] Filed: Jul. 24, 1989

[51] Int. Cl.[5] ..... C25C 3/00; C25C 3/08; C25C 3/22

[52] U.S. Cl. ..... 204/1.5; 204/64 R; 204/241; 204/245; 204/246; 204/247; 204/273; 204/292; 204/294

[58] Field of Search ..... 204/1.5, 64 R, 240, 204/245, 246, 273, 292, 243 R, 247, 294, 241

[56] References Cited

U.S. PATENT DOCUMENTS

| | | | |
|---|---|---|---|
| 2,707,168 | 4/1955 | Wainer et al. | 204/246 X |
| 2,893,928 | 7/1959 | Kolodney | 204/64 R X |
| 2,923,670 | 2/1960 | Bjorklund et al. | 204/64 R X |
| 3,052,611 | 9/1962 | Piper | 204/1.5 |
| 3,098,028 | 7/1963 | Mullins, Jr. et al. | 204/1.5 X |
| 3,213,002 | 10/1965 | Benedict | 204/1.5 |
| 3,282,806 | 11/1966 | Long et al. | 204/1.5 |
| 3,330,742 | 7/1967 | Piper | 204/1.5 |

FOREIGN PATENT DOCUMENTS

| | | | |
|---|---|---|---|
| 1104036 | 11/1955 | France | 204/64 R |

OTHER PUBLICATIONS

Uranium Refining and Conversion, The Atomic Energy Desk Book, Reinhold Publishing, New York, 1963.

T. A. Henrie, "Electrowinning Rare-Earth and Uranium Metals From Their Oxides", Journal of Metals, Dec. (1964). pp. 978-981.

Other Methods of Manufacturing Metallic Uranium, N. P. Galkin et al., *Technology of Uranium,* N. P. Galkin and B. N. Sudarikov, Eds., Atomized, Moskva, 1964 (English Translation, Israel Program for Scientific Translations, Jerusalem, 1966).

R. D. Piper, "Production of Uranium Metal from Uranium Oxide by Fused Salt Electrolysis", Electrochemical Technology, vol. 5, No. 3-4, Mar.-Apr. 1967, pp. 147-151.

B. F. Greenfield et al., "The Solubility of Uranium Dioxide in Fluoride Melts", United Kingdom Atomic Energy Authority, Harwell, AERE-R 6463, Feb. (1983).

R. D. Piper et al., "Electrolytic Production of Uranium Metal from Uranium Oxides", Ind. Eng. Chem. Process Design Develop., 1, 208 (1962).

L. W. Niedrach et al., "The Preparation of Uranium Metal by the Electrolytic Reduction of Its Oxides", Journal of Electrochemical Society, vol. 105, No. 6, pp. 353-358.

*Primary Examiner*—Donald R. Valentine

*Attorney, Agent, or Firm*—James W. Weinberger; Robert J. Fisher; William R. Moser

[57] ABSTRACT

An apparatus and process for reducing uranium and/or plutonium oxides to produce a solid, high-purity metal. The apparatus is an electrolyte cell consisting of a first container, and a smaller second container within the first container. An electrolyte fills both containers, the level of the electrolyte in the first container being above the top of the second container so that the electrolyte can be circulated between the containers. The anode is positioned in the first container while the cathode is located in the second container. Means are provided for passing an inert gas into the electrolyte near the lower end of the anode to sparge the electrolyte and to remove gases which form on the anode during the reduction operation. Means are also provided for mixing and stirring the electrolyte in the first container to solubilize the metal oxide in the electrolyte and to transport the electrolyte containing dissolved oxide into contact with the cathode in the second container. The cell is operated at a temperature below the melting temperature of the metal product so that the metal forms as a solid on the cathode.

11 Claims, 2 Drawing Sheets

APPARATUS AND PROCESS FOR THE ELECTROLYTIC REDUCTION OF URANIUM AND PLUTONIUM OXIDES

CONTRACTUAL ORIGIN OF THE INVENTION

The U.S. Government has rights in this invention pursuant to Contract No. W-31-109-ENG-38 between the U.S. Department of Energy and University of Chicago.

BACKGROUND OF THE INVENTION

The invention relates to a method and apparatus for reducing uranium and/or plutonium oxides to the metal. More specifically, this invention relates to a method and apparatus for electrolytically reducing uranium and/or plutonium oxides to a high-purity metal product.

High-purity uranium metal is the required feed material for enrichment of $^{235}U$ by the Atomic Vapor Laser Isotope Separations (AVLIS) process. A supply of high-purity uranium and plutonium metals is also important in the preparation of nuclear reactor fuel rods.

Uranium metal can be prepared from uranium oxides by a variety of methods. The commercial method for the production of uranium metal consists of converting the uranium oxides to $UF_4$, and then reducing the $UF_4$ to metal with calcium by thermochemical reduction. The uranium oxides can also be reduced by electrolytic methods using a molten salt as the electrolyte. Both processes are carried out at high temperatures (1200° C. or higher) and the product is collected as liquid metal. Chemical reductions involving a liquid mixture such as a zinc-magnesium alloy as the reductant at temperatures of 700°-800° C. have been demonstrated in the laboratory. In this process, the uranium metal product is recovered by vaporizing off the solvent metals in a distillation or retorting operation.

Electrolytic processes for the reduction of uranium oxides to uranium metal have advantages over chemical reduction methods. For example, they do not produce the by-product wastes which must be disposed of that chemical methods do, they generally operate at a lower temperature which reduces the problem of finding suitable materials for the process equipment, they can be operated in such a way as to minimize recycle streams in the process, and they can produce a high-purity product.

Several electrolytic processes have been developed for the production of uranium metal from various uranium salts. U.S. Pat. No 3,330,742, describes a method for electrolytically reducing uranium hexafluoride to uranium metal in a fused salt. The $UF_6$ gas is contacted with a graphite anode and an electrolyte containing $UF_4$ and an alkaline earth fluoride at about 1150° C. Carbon tetrafluoride gas is evolved at the anode while the molten uranium metal forms as a pool at the cathode. Another process is based on the concept of the Hall Process for producing molten aluminum from its oxides in that the oxygen reacts with carbon at the anode to form oxides of carbon. The process was found to be operable and uranium metal was obtained However, the metal product suffered from poor coalescence caused by oxide contamination and low product yields. Other processes have incorporated the uranium oxides into a consumable oxide-carbon anode. Still other processes have tried feeding the uranium oxide directly into the cell, utilizing the crucible as the cathode.

All the processes for the electrolytic reduction of uranium oxides suffer from difficulties which are related to the low solubility of the uranium oxides in the electrolyte. The high operating temperatures of the prior art processes, not only increase operating costs, but produce a molten uranium metal product which is contaminated with insoluble uranium oxides from the electrolyte. These impurities produce poorly coalesced uranium metal particles requiring extensive purification and processing before the metal product can be further utilized.

SUMMARY OF THE INVENTION

A method and apparatus has been developed for the electrolytic reduction of uranium and/or plutonium oxides which produces a high-purity solid product and thus eliminates many of the problems attendant with the previously described methods for reducing uranium oxides to uranium metal.

The apparatus of the invention consists of an electrolytic cell having a first container for receiving an electrolyte, a relatively smaller second container having an open top located within the first container, an electrolyte in the first and second containers for receiving and solubilizing the metal oxides to be reduced, the level of the electrolyte in the first container being above the top of the second container, a rod-shaped anode having a lower end extending into the electrolyte in the first container, gas delivery means for delivering a supply of inert gas to the lower end of the anode in the electrolyte for sweeping gases from the surface of the anode. A cathode extending into the electrolyte in the second container, heating means for melting the electrolyte, means for passing a current between the cathode and the anode, and mixing means in the first container for mixing and stirring the electrolyte to dissolve the oxides and for moving the electrolyte containing the dissolved oxides into contact with the cathode in the second container, whereby the dissolved oxides in the electrolyte are reduced to a metal which forms as a high-purity solid on the cathode in the second container. Preferably, the anode is enclosed in an outer concentric shielding tube which extends into the electrolyte, forming an annular space between the inner wall of the tube and the anode for channeling gases formed on the anode from the electrolytic cell.

The process of the invention, for electrolytically reducing metal oxides to a high-purity solid metal, consists of providing an electrolytic cell having a relatively large first container, a smaller second container having an open top located within the first container, an electrolyte filling the first and second containers, the level of the electrolyte in the first container being above the top of the second container, an anode in the electrolyte in the first container, a cathode in the electrolyte in the second container, heating the electrolyte to a temperature sufficient to melt the electrolyte, adding metal oxides to the molten electrolyte in the first container, stirring and mixing the electrolyte to dissolve some of the oxide and for moving the electrolyte containing dissolved oxides into contact with the cathode in the second container, passing a supply of inert gas into the electrolyte near the anode to sparge the electrolyte and to remove any gases formed in the anode, and passing a current between the electrodes to electrolytically reduce the dissolved metal oxides to the metal, whereby high-purity metal is formed as a solid on the cathode within the second container.

While the invention is generally described in terms of reducing uranium oxides to uranium metal, it is equally useful for the similar reduction of plutonium oxides to plutonium metal by reducing the operating temperature of the cell to below the melting temperature of plutonium metal and adjusting the composition of the electrolyte to increase solubility of plutonium oxide.

It is therefore one object of the invention to provide an improved method and apparatus for reducing metal oxides to solid metal.

It is another object of the invention to provide a method and apparatus for the electrolytic reduction of uranium oxides and plutonium oxides to provide a solid metal.

It is finally the object of the invention to providing an improved electrolytic method and apparatus for reducing of uranium oxides and plutonium oxides to a solid mass of high purity metal.

DETAILED DESCRIPTION OF THE INVENTION

Figure 1:
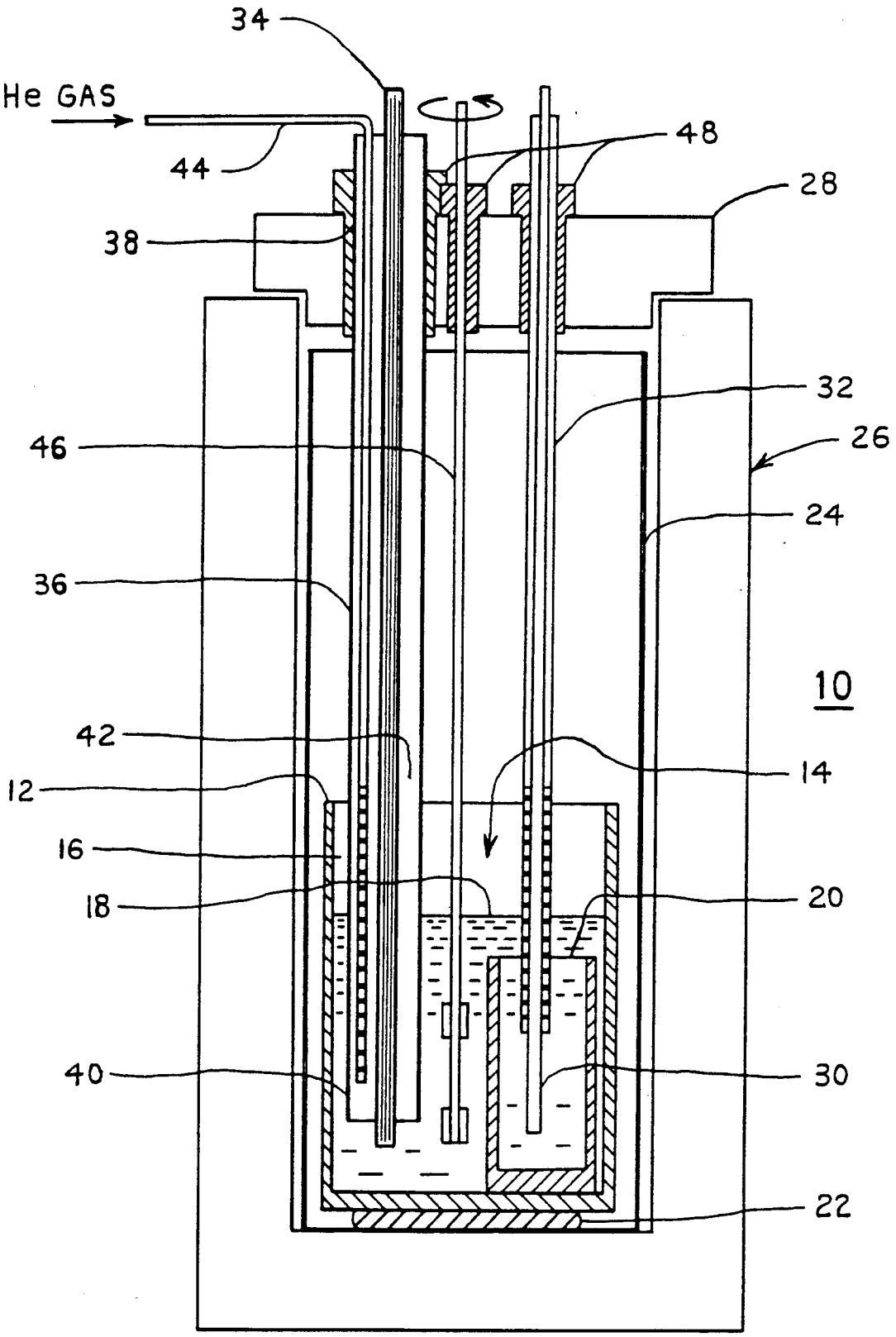
FIG. 1 is a cross-sectional view of the apparatus of the invention.

Referring now to the drawing which discloses one embodiment of the invention, the apparatus 10 of the invention consists of an open-top crucible 12, preferably of graphite, which serves as the electrolytic cell 14 of the invention, forming a first container 16 for receiving the electrolyte 18. A second smaller open-top container 20, also of graphite, is located within container 16, below the level of electrolyte 18 so that the electrolyte 18 can freely flow between the two chambers. Crucible 12 sits on an insulator pad 22 inside a tantalum furnace liner 24 which is placed inside of an open-top furnace 26, and is sealed by a firebrick insulation cover 28. Penetrating cover 28 and extending downward into the electrolyte near the bottom of second container 20 is cathode 30, which may be molybdenum or uranium. Cathode 30 is protected by electrical insulator 32, the upper portion of which is preferably of alumina while the lower portion is boron nitride to resist corrosion by electrolyte 18. The extreme lower portion of cathode 30 is uncovered to contact the electrolyte. Also penetrating cover 28 is a vertical rod-shaped graphite anode 34 which extends into electrolyte 18 in container 16. Enclosing anode 34 is an outer, concentric, tubular-shaped shielding tube 36 having an upper end 38, extending from above cover 28, and a lower end 40, extending into electrolyte 18 near the bottom of container 16. An annular space 42 is formed between the inner surface of tube 36 and anode 34. The upper portion of tube 36, is constructed of alumina, while the lower portion in contact with the elecrolyte is boron nitride. Extending downward through annular space 42 to a spot near the lower end 40 of tube 36, is a small diameter tube 44 for delivering a supply of inert sparging gas into the electrolyte near the lower end of anode 34 for sparging the electrolyte and for removing any anode gases which may form on the surface of the anode during cell operation. The lower end of tube 44 is constructed of boron nitride to resist corrosion by the electrolyte. A power supply, not shown, provides electrical power to electrodes 30 and 34. A paddle stirrer 46, preferably of molybdenum, also penetrates cover 28 and extends into electrolyte 18 in first chamber 16, for stirring and mixing the electrolyte in chamber 16 to dissolve the metal oxides and to circulate the electrolyte containing dissolved oxides into contact with cathode 30 in container 20. Rotational means, not shown, is provided stirrer 46. Penetrations of cover 28, by electrode 30, shielding tube 36 and stirrer 46 are provided by boron nitride seals 48.

In operation, the electrolyte salt in cell 16, having the composition: 45.6 mole % LiF, 41.2 mole % KF, 11.7 mole % NaF and 1.5 mole % $CaF_2$ and containing about 7 to 8 mole % $UF_4$ is heated to about 950° C. to melt the electrolyte. Uranium oxide is added to the electrolyte in container 16 in an amount sufficient to make the electrolyte about 6 weight % in uranium oxide, whereby some of the oxide dissolves in the electrolyte. Paddle stirrer 46 in container 16 is rotated at about 200 rpm to mix and stir the electrolyte while helium sparging gas at a flow rate of about 6 liters per hour is passed over the anode to remove any anode gases which may form on the anode. A current sufficient to reduce the oxide to the metal is applied between anode 34 in chamber 16 and cathode 30 in chamber 20, whereby high purity uranium metal is deposited as a solid on the cathode 30 in second container 20.

The preferred electrolyte salt is composed of 45.6 mole % LiF, 41.2 mole % KF, 11.7 mole % NaF and 1.5 mole % $CaF_2$, and has a melting temperature of about 450° C. Other fluoride salts such as 50 mole % $BaF_2$ and 50 mole % $MgF_2$, or equivalent molar mixtures of $BaF_2$ and LiF should also be satisfactory as might combinations of fluoride and chloride salts. The electrolyte may be any combination of salts which has a melting temperature well below the melting temperature of uranium metal, in which the uranium oxides are soluble to the greatest extent possible, and which is chemically stable under the cell operating conditions.

The electrolyte contains 6 to 14, preferably 7 to 8 mole % $UF_4$ to aid in solubilizing the uranium oxides. Concentrations below 6 mole % are insufficient to affect the solubility of the oxides in the electrolyte, while concentrations of $UF_4$ above 14 mole % no longer increase uranium oxide solubility and may ultimately itself be reduced to the metal, thereby increasing operating costs.

The uranium oxide may be either $UO_2$, $U_3O_8$ or $U_3$ since the higher oxides such as $U_3O_8$ and $UO_3$ are thermally decomposed to $UO_2$ at the cell operating temperature. The amount of uranium oxide to be added to the electrolyte is an amount sufficient to saturate the electrolyte plus a small surplus. Since the solubility of the oxide in the electrolyte under the preferred operating conditions is about 5 wt %, sufficient uranium oxide should be added to the electrolyte to make the electrolyte about 6–8 weight percent in oxides. Amounts greater than about 8 wt % will result in increased undissolved oxide solids which could contaminate the final product. The oxides may be added in any convenient form, such as a powder or pellets.

The operating temperature of the cell may vary from below the melting temperature of uranium metal (1132° C.) to about 950° C., preferably 975°-1000° C. Temperatures below about 950° C. were found to substantially decrease the amount of uranium metal product produced. This is believed probably due to decreased solubility of uranium oxide in the electrolyte at temperatures below 950° C.

Stirring and mixing of the electrolyte during reduction of the oxides is necessary to suspend the oxides in the electrolyte to maintain a saturated solution of oxides in the electrolyte and transport the electrolyte containing the dissolved oxides into contact with cathode 30 in second chamber 20 so that reduction may take place.

The cathode may be any conductive metal capable of withstanding corrosion by the electrolyte, such as mobybdenum or uranium. Preferably the upper portion of the cathode is covered with an electrical insulator such as alumina, while the lower portion was covered with boron nitride to resist corrosion by the electrolyte. The extreme lower portion, or about 8 $cm^2$ for the apparatus shown, is left uncovered to provide electrical contact with the electrolyte.

The anode shielding tube serves as a shield to reduce the back reaction of CO at the cathode, as a channel for directing gases such as $CO_2$, CO and $CF_4$ generated in the electrolyte cell out of the cell, an for channeling the sparging gas into the electrolyte in contact with the anode.

Helium is the preferred sparging gas, while other inert gases such as argon should also prove satisfactory. Delivery of the gas to the lower end of the anode within the anode shielding is important to the operation of the process to prevent the "anode effect" by sweeping away the gases formed at the anode surface, such as CO and $CO_2$, which could otherwise block the surface and inhibit current transfer between the anode and the electrolyte, and to sparge or agitate the electrolyte at the interface with the anode surface, to improve mass transfer. Generally, for the apparatus shown, a gas flow rate of 6 to 7 liters per hour was found satisfactory.

The second container serves to partially isolate the cathode from much of the undissolved metal oxide particles suspended in the circulating electrolyte thereby reducing the possibility of such particles being incorporated into the pure metal being formed on the cathode during the reduction operation.

The uranium metal produced by the process of the invention has a very high degree of purity, and is suitable for directly incorporating into further processing streams for the preparation of fuel elements or for isotope enrichment.

The following Examples are provided to illustrate the method and operation of the apparatus of the invention and are not to be taken as limiting the scope of the invention which is defined in the appended claims.

EXPERIMENTAL CONDITIONS

Three series of experimental runs were made. A new cell and a fresh electrolyte salt were used for each series of runs. However, the electrolyte salt composition was essentially the same for all these series of experiments, i.e., about 600 g of the quaternary fluoride eutectic as herein before described plus about 350 g of $UF_4$ (approximately 7.0 mole % $UF_4$ in the electrolyte).

The experiments were conducted in a glove-box facility in which a high-purity helium atmosphere was maintained to prevent reactivity of the molten fluorides with oxygen and moisture. The moisture level of helium was maintained below 3 ppm and the oxygen level below 15 ppm.

The anode was a graphite rod of 1.27 cm diameter, positioned inside a shielding tube of 2.54 cm inside diameter and 0.32 cm wall thickness. The cathode used in all these tests was a 0.635 cm diameter molybdenum rod, with the exception of one test in which a uranium rod 0.56 cm in diameter was used. The diameter of the cathode was about half that of the corresponding graphite-rod anode, to provide a high ratio of anode to cathode areas for the purpose of obtaining a relatively low anode current density to reduce the anode effect.

The cell vessel was a graphite crucible having an outside diameter of 10.16 cm, a depth of 11.43 cm and a wall thickness of 0.63 cm. The crucible containing the electrolyte was placed inside a secondary tantalum container which was then positioned in a furnace chamber.

The helium sparging gas was preheated to about 500° C. to prevent the formation of cold spots in the electrolyte adjacent to the anode surface. The helium gas flow rate was about 6 to 7 standard liters/hour. The paddle stirrer used to provide agitation of the bulk-phase electrolyte has 2 pairs of blades, each 0.5 cm wide and 0.95 cm long. The stirrer shaft was a molybdenum rod with a diameter of 0.64 cm and a length of 38.1 cm.

The electrolyte salt was added to the graphite crucible. The top opening of the furnace chamber was closed and the cell was heated to about 580° C. to melt the electrolyte salt. After the salt had melted, about 60 g of uranium oxide (approximately 6 wt % of the electrolyte) was added to the electrolyte. The cell was then heated overnight at about 580° C. The electrodes, gas sparger, the anode shielding tube, and the paddle stirrer were then installed in the cell, and the crucible contents were stirred. The cell temperature was increased to the predetermined operating temperature of 775° to 975° C., and the electrical connections to the cell were made. Gas sparging of the electrolyte adjacent to the anode surface was started. The helium flow rate was adjusted to about 7 standard liters/hour. The rotational speed of the paddle stirrer was adjusted to about 200 rpm. After about 30 minutes on open circuit, electrolysis was initiated. At the completion of a run (ranging from 5 to 6 hours), the stirring and gas sparging of the electrolyte were discontinued, the electrolysis circuit was opened, and the cell was allowed to cool.

EXAMPLE I

To determine the lowest possible temperature for the electrolytic reduction process, three experimental runs (Run 1A, 1B, and 1C) were made at three different temperatures: 775°, 875°, and 975° C. The flow rate of sparging gas was maintained at about 7 standard liters/-hour, and the rotational speed of the paddle stirrer at about 200 rpm.

The results of these tests showed that at the lower temperatures of 775° and 875° C., the cell voltage was high (4.5 to 7.0 V) and unstable during the entire run even at a low current density of about 50 $mA/cm^2$ (based on the apparent cathode surface area of about 8.0 $cm^2$).

The two runs made at 775° and 875° C. (Runs 1A and 1B) failed to produce any observable metallic uranium deposit on the cathode.

At a higher temperature of 975° C., the electrolytic reduction process could be carried out at a much higher current density of about 115 $mA/cm^2$. The cell voltage was much lower (2.3 to 2.6 V), relatively stable, and showed no oscillations during electrolysis. Most importantly, a metallic uranium deposit was obtained from this run (Run 1C). Failure to electrolytically deposit uranium at the two low temperatures was related to the solubility of uranium oxide in the molten fluoride electrolyte

EXAMPLE II

To study the effects of bulk phase electrolyte agitation and gas sparging on the electrolytic reduction process, Run 1D, was made at 975° C.

Figure 2:
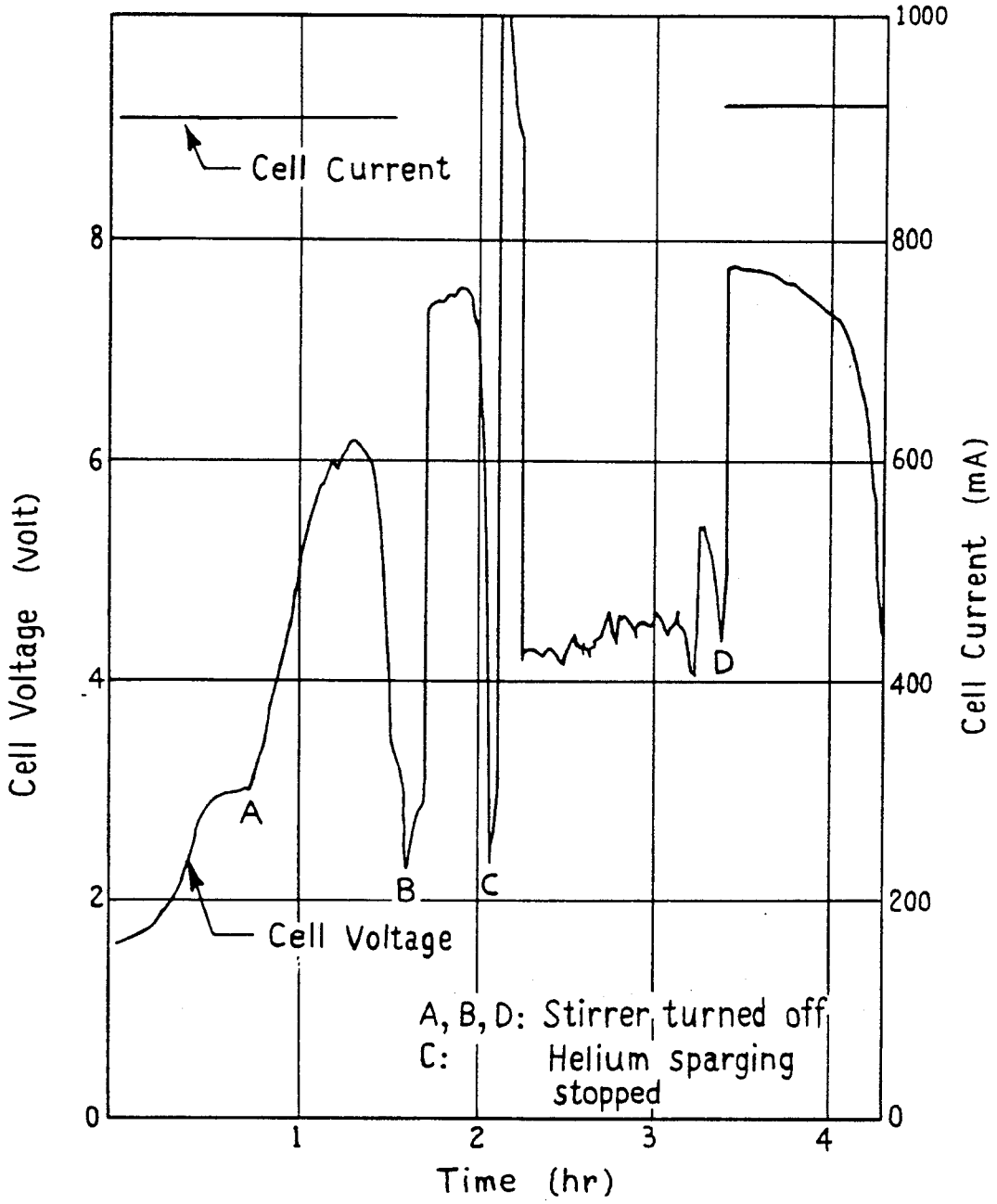
FIG. 2 is a cell voltage vs time curve showing the effects of electrolyte agitation and helium sparging

The test was made by starting the electrolysis with both the gas sparger (helium gas flow rate of 7 standard liters/hour) and the paddle stirrer system (rotational speed of 200 rpm) on. After about 45 min., when the operating conditions and the cell voltage were stabilized, either the gas-sparging system or the paddle stirrer was turned off alternatively for a period of time. As shown in FIG. 2, which presents the cell-voltage-vs-time curves recorded during this test, the responses of the cell voltage to these operating variables were clear and definite. The results showed that, when the paddle stirrer used for agitating the bulk phase electrolyte was turned off, the cell voltage rose to a much higher level (by a difference of 2 to 3.5 V), as shown by points A, B, and D in FIG. 2) and then stabilize at that level. However, when the sparging gas was cut off, as shown by point C in FIG. 2, the cell voltage showed a very steep increase up to a level above the preset cell voltage control limit of 10.0 V. This sharp increase in cell voltage caused immediate interruption of the current flow through the cell.

These results indicate clearly that gas sparging of the electrolyte adjacent to the anode surface is critical for continuous and stable operation of the electrolytic reduction process.

EXAMPLE III

A second series of five experiments, Runs 2A to 2E, were performed under the following standard operating conditions: a cell temperature of 975° C., a helium flow rate of 7 standard liters per hour for the gas-sparging system, and a rotational speed of about 200 rpm for the paddle stirrer.

The first run, 2A, was made without adding any uranium oxide to the electrolyte contained in the cell. It was an electrolytic reduction test carried out on the blank molten electrolyte. The results showed that, during the electrolysis, only a very low current density ( 25 to 37 mA/cm$^2$) could be maintained at a relatively high cell voltage of 4.5 to 6.0 V. The cell voltage curve also showed strong oscillation and cyclic patterns.

At the completion of this run, no metallic deposit could be observed on the cathode surface, which indicated that the electrolytic reduction of $UF_4$ to produce a uranium metal deposit under stated operating conditions is very difficult.

Before the start of the next four runs (2B to 2E) approximately 60 g of $UO_2$ pellets was added to the cell. The cell contents were stirred for about two hours. Runs 2B through 2E were then carried out in sequence.

The cathode used for Run 2D was a uranium rod of 0.56 cm diameter rather than a molybdenum rod 0.635 cm in diameter. This was done to study the effect of different substrate materials on the adherence of the metallic deposits.

The cell-voltage-vs-time curves for Run 2B to 2E indicate that, during electrolysis, a relatively higher current density (~75 mA/cm$^2$) could be maintained, and the cell voltages were relatively low (2.3 to 2.9 V) and were very stable during the entire period of electrolysis.

A good metallic cathode product was obtained from each of these test runs. The morphology of the metallic uranium deposits was dendritic. Because of the adhering and occluded electrolyte, the cathode products showed a dark green color with a shade of brown.

A total of about 23 g of cathode products was recovered from these four deposits. Sample of the cathode products analyzed and the results of the analyses are presented in Table 1.

TABLE 1

Analytical Results of the Cathode Products from Test Runs 2B to 2E

| Element | Deposit I (wt %) | Deposit II (wt %) |
|---|---|---|
| Uranium[a,b] | 74.12 ± 0.003 | 60.70 ± 0.003 |
| Potassium[c] | 10.61 | 14.95 |
| Lithium[c] | 2.15 | 2.97 |
| Calcium[c] | 0.44 | 0.59 |

[a]By X-ray diffraction, deposited uranium metal was determined to be α-uranium.
[b]Includes uranium in $UF_4$ contained in the electrolyte adhering or occluded in the dendritic deposit.
[c]From the electrolyte adhering or occluded in the dendritic deposit (estimated uncertainty is 5%).

The major conclusions from these results are: 1) the metallic uranium contained in the cathode products was about 60 wt % on the average (excluding uranium in $UF_4$ contained in the occluded or adhering electrolyte); the balance was essentially electrolyte; 2) the metal products were α-uranium of high purity and showed no oxide contamination; and 3) the total uranium metal actually produced from these four runs was approximately 13.8 g (which is 60 % of the gross weight of the total cathode products of 23g). However, the total amount of electricity passed through the cell during these tests was about 11.35 Ah, which, based on the cathode reaction should theoretically have produced 25.197 g uranium metal. Therefore, the average current efficiency for these four electrolytic reduction rests was approximately 53%.

Before and after Runs 2B through 2E, three dip samples of the electrolyte, weighing 1 to 2 grams each were taken from different locations in the cell and analyzed for oxygen. The purpose of these samples was to determine the consumption of uranium oxide during electrolysis.

The electrolyte samples, along with a sample of blank fluoride eutectic salt were analyzed for oxygen. The results are shown in Table 2 below.

TABLE 2

Analytical Results of the Oxygen Concentration in the Electrolyte. (Weighted average)

| | |
|---|---|
| Blank fluoride eutectic: | 0.16 ± 0.07 wt % |
| Initial oxygen concentration: (before electrolysis | 0.92 ± 0.10 wt % |
| Final oxygen concentration: (after electrolysis) | 0.51 = 0.08 wt % |

Notes:
[1]Calculated initial oxygen concentration attributed to the added $UO_2$ in the electrolyte = 0.71 wt %
[2]Total uranium metal deposited on the cathodes = 14 g
[3]Total weight of the electrolyte (including $UO_2$) = 1005 g The calculated results indicated that, the amount of $UO_2$ lost from the electrolyte agrees with the total amound of uranium metal deposited on the cathodes in these electrolytic reduction tests. This indicates that the uranium metal from the cathode products obtained from these tests was derived from the reduction of $UO_2$ dissolved in the electrolyte.

EXAMPLE IV

A third series of runs was made (Run 3A and 3B) under the same operating conditions as Example III except that the uranium oxide used was 60 grams of $U_3O_8$ powder.

A comparison with the cell voltage curves for Run 2B to 2E with the voltage curves for these runs indicate that, in these two tests, the cell voltage during electrolysis was generally higher (2.5 to 3.7 V). It was also relatively unstable. It showed periods of ups and downs, small oscillations, and instantaneous short circuits in the cell. It was observed that, after adding $U_3O_8$ powder to the cell, a film of powder formed at the surface of the electrolyte, and this powder film may have caused intermittent shorting between the anode and cathode. It was also observed that, with the $U_3O_8$ powder, dewetting of the surfaces of the electrodes and the inside wall of the electrolytic cell occurred (an effect possibly caused by impurities), which could account for the higher electrolysis voltages required.

The uranium metal deposits obtained from these runs had the same dendritic character and overall appearance as observed in Runs 2B and 2E. The current efficiencies estimated for these two runs were lower, about 40% for Run 3A, and 30% for Run 3B. However, these values are less accurate thant the value of 53% obtained for Run 2B–2E, because of the intermittent short circuits.

An analysis of the deposits reported that the carbon content was below 200 ppm, the lower limit of detection of the analytical procedure that was employed. The original carbon content of the $U_3O_8$ powder was about 442 ppm. Thus, the process served to purify the oxide of carbon contamination.

As shown by the proceeding discussion and examples, the process and apparatus of the invention provides a substantial improvement on prior art methods for the electrolyte reduction of uranium and plutonium oxides to a high purity solid uranium or plutonium metal.

The embodiment of the invention in which an exclusive property or privilege is claimed is defined as follows:

1. An apparatus for electrolytically reducing metal oxides selected from the group consisting of uranium and plutonium to solid, high-purity metal comprising:

an electrolytic cell having a first container for receiving an electrolyte, a relatively smaller second container, having an open top, located within the first container, an electrolyte in the first and second containers for receiving and solubilizing the oxides to be reduced, the level of the electrolyte in the first container being above the top of the second container, a rod-shaped carbon anode having a lower end extending into the electrolyte in the first container, gas delivery means for delivering a supply of inert gas into the electrolyte near the lower end of the anode to sparge the electrolyte and sweep gases from the surface of the anode, an outer concentric, tubular-shaped shield enclosing the anode, the shield having a lower end extending into the electrolyte in the first container, said tube being spaced from the anode to form an annular space therebetween for removing gases which form on the anode from the cell, a cathode having a lower end extending into the electrolyte in the second container, heating means for melting the electrolyte, means for passing a current between the anode and cathode, and mixing means in the first container for mixing and stirring the electrolyte to dissolve the oxides and for moving the electrolyte containing the dissolved oxides into contact with the cathode in the second container, whereby the oxides in the electrolyte are reduced to high-purity metal which forms as a solid on the cathode within the second chamber.

2. The apparatus of claim 1 wherein the gas delivery means is a tube extending down the annular space between the shielding tube and the anode.

3. The apparatus of claim 2 wherein the electrolyte consists of one or more members selected from the group consisting of LiF, KF, NaF, $CaF_2$, $BaF_2$, and $MgF_2$, and also contains $UF_4$.

4. The apparatus of claim 3 wherein the cathode is constructed of a material selected from the group consisting of molybdenum and uranium.

5. The apparatus of claim 2 wherein the mixing means in the first container is a paddle stirrer having blades extending from a control rotatable shaft and includes means for rotating the shaft.

6. The apparatus of claim 5 wherein the electrolyte is about 45.6 mole % LiF, 41.2 mole % KF 11.7 mole % NaF and 1.5 mole % $CaF_2$, and contains about 6 to 8 mole % $UF_4$.

7. A process for electrolytically reducing metal oxides selected from the group consisting of uranium and plutonium to high-purity solid metal comprising:

providing an electrolytic cell having a first container, a relatively smaller second container within the first container, an electrolyte in the cell filling both containers, the level of the electrolyte in the first container being above the top of the second container, an anode in the electrolyte in the first container, means in the electrolyte for passing a sparging gas over the anode, a cathode in the electrolyte in the second container, stirring means in the first container for stirring and mixing the electrolyte and for circulating the electrolyte between the two chambers, heating the electrolyte to a temperature between 900 degrees C and the melting temperature of the metal to be produced, adding the metal oxide to the heated electrolyte in the first chamber, electrolytically reducing the metal oxide to metal while stirring and mixing the electrolyte in the first container and circulating the electrolyte containing the dissolved oxides between the chambers, whereby high-purity metal forms as a solid on the cathode within the second chamber.

8. The method of claim 7 wherein the electrolyte consists of one or more members selected from the group consisting of LiF, KF, NaF, $CaF_2$, $BaF_2$, and $MgF_2$, and also contains $UF_4$.

9. The method of claim 8 wherein the electrolyte is about 45.6 mole % LiF, 41.2 mole % KF 11.7 mole % NaF and 1.5 mole % $CaF_2$, and contains about 6 to 8 mole % $UF_4$.

10. The method of claim 9 wherein the metal oxides are uranium oxides and the electrolyte is heated to between 900° C. and 1130° C.

11. The method of claim 10 wherein the electrolyte is heated to between 950° C. and 1000° C.

* * * * *